US005362289A

United States Patent [19]

Holt

[11] Patent Number: 5,362,289

[45] Date of Patent: Nov. 8, 1994

[54] MARTIAL ARTS FOCUS TRAINING APPARATUS AND WALL MOUNT

[76] Inventor: Todd Holt, 303 Valleywood Dr., Forest, Va. 24551

[21] Appl. No.: 76,957

[22] Filed: Jun. 16, 1993

[51] Int. Cl.[5] ..... A63B 69/34

[52] U.S. Cl. ..... 482/83; 482/88; 434/247; 428/58

[58] Field of Search ..... 482/83-90, 482/148; 472/57, 91, 140; 434/247; 428/58-60; 269/87.2, 74, 3, 264, 88

[56] References Cited

U.S. PATENT DOCUMENTS

| | | | |
|---|---|---|---|
| 4,403,772 | 9/1983 | Stangle | 482/83 |
| 4,491,316 | 1/1985 | Prince | 482/83 |
| 4,572,504 | 2/1986 | DiBartolo | 482/83 |
| 4,583,730 | 4/1986 | Gecht et al. | 482/83 |
| 4,662,630 | 5/1987 | Dignard et al. | 482/83 |
| 4,732,378 | 3/1988 | LeFebvre et al. | 482/88 |
| 4,757,989 | 7/1988 | Bauer | 482/83 |
| 4,776,584 | 10/1988 | Tilley et al. | 482/83 |
| 4,787,625 | 11/1988 | Chaloux | 482/87 |
| 4,801,140 | 1/1989 | Bergeron | 482/146 |
| 4,883,635 | 11/1989 | Goradesky | 482/83 |
| 4,889,334 | 12/1989 | Partlo | 482/83 |
| 5,131,896 | 7/1992 | Hutchings | 482/83 |

FOREIGN PATENT DOCUMENTS

| | | | |
|---|---|---|---|
| 0018670 | of 1911 | United Kingdom | 482/88 |

*Primary Examiner*—Stephen R. Crow
*Assistant Examiner*—Jerome Donnelly
*Attorney, Agent, or Firm*—Joseph L. Spiegel

[57] ABSTRACT

Martial arts focus training apparatus comprises a backboard on which boards to be struck and broken by a practitioner are supported on and spaced from the backboard. The backboard may be grasped by holders assisting the practitioner via slots. An extender permits additional boards to be held on the apparatus. Handle extension means allows the backboard to be held to the side while positioned against a wall. A wall mount for the apparatus permits rotary, pivotal and vertical positioning of same.

5 Claims, 9 Drawing Sheets

MARTIAL ARTS FOCUS TRAINING APPARATUS AND WALL MOUNT

BACKGROUND OF THE INVENTION

1. Field of the Invention

This invention relates to martial arts focus training apparatus and in particular to apparatus for supporting boards to be struck and broken by a practitioner and a wall mount for such apparatus to permit rotary, pivotal, and vertical positioning of same.

2. Description of the Prior Art

In the field of martial arts, a common focus training exercise is that of board breaking. A martial arts performer will utilize a hand, elbow, or foot to strike a blow to a board or a stack of boards and break same.

Various ways and means have been devised for holding the boards during striking. For example, the boards are held by individuals assisting the performer who hold the boards between them.

To overcome the obvious safety risks involved in manual holding of the boards themselves, various apparatus have been devised. Such apparatus are still lacking in safety, expensive and somewhat cumbersome to manufacture, not readily adapted to wall mounting, and when so mounted, limited in the positions in which the board may be presented to a practitioner.

SUMMARY OF THE INVENTION

An object of the invention is an improved martial arts focus training apparatus that is safe to use and easy to manufacture.

Another object of the invention is such an apparatus that permits same to be held to the side and against a wall for safety and for much stronger backing.

Still another object is a wall mount for such an apparatus that permits rotary, pivotal and vertical positioning of same.

These and other objects, features, and advantages of the present invention are accomplished in accordance with the teachings of the present invention, one embodiment of which comprises an apparatus useful in martial arts focus training for holding boards to be struck and broken by a practitioner comprising a backboard, board support means including means for holding boards, and for spacing same from the backboard, means to permit holding of boards on the board support means, and means to allow the backboard to be grasped by holders assisting the practitioner. The backboard is slotted at its corners to form backboard grasping means. Extension means are provided to permit holding of additional boards on the apparatus. Handle means are provided to permit holding of the apparatus to the side and against a wall. The apparatus may be secured to a wall mount permitting the boards to be presented to a practitioner in various planes at various angles, and at different heights.

BRIEF DESCRIPTION OF THE DRAWING

Other objects, features, and advantages of the invention will be apparent from the following detailed description and accompanying drawing wherein.

DETAILED DESCRIPTION

Figure 1:
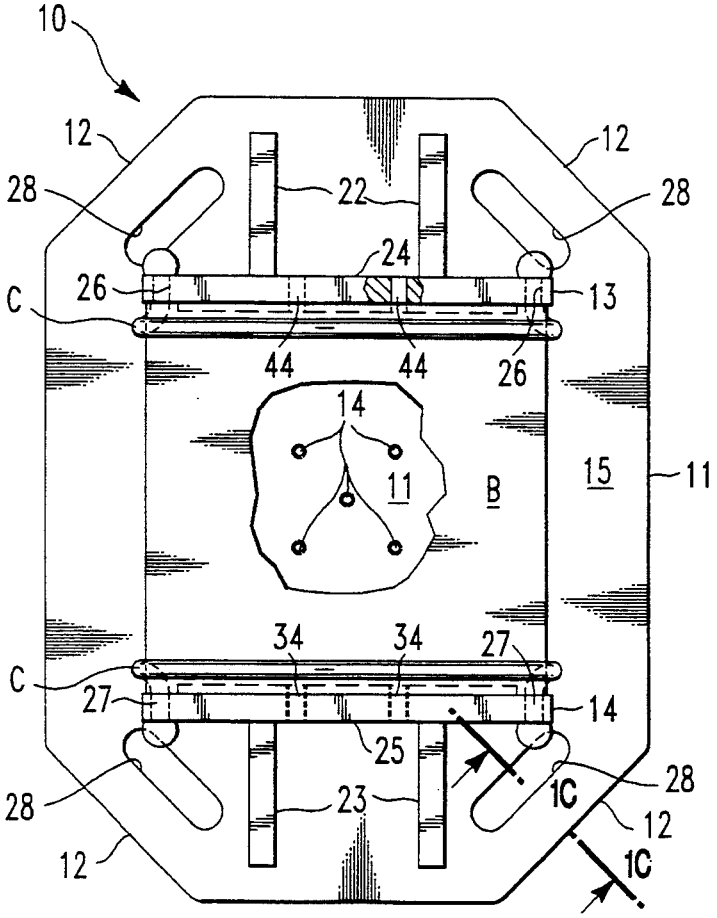
FIG. 1 is a front view of the novel apparatus of the present invention.
Figure 1B:
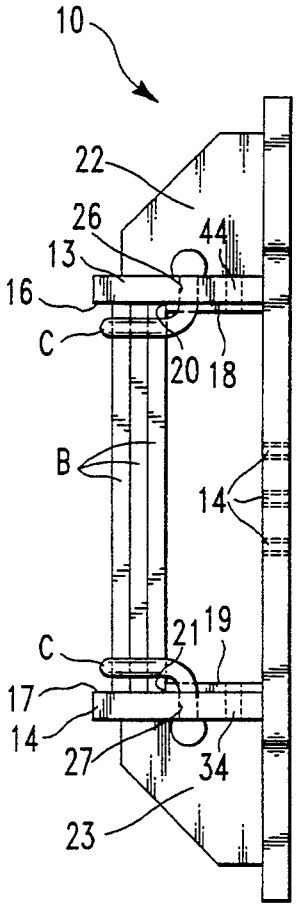
FIG. 1B is a side view of the apparatus.
Figure 1A:
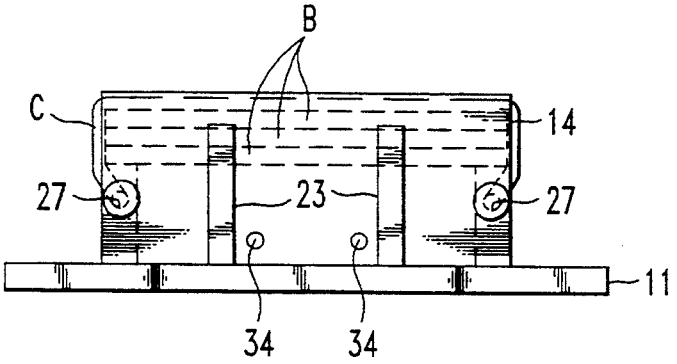
FIG. 1A is a top view of the apparatus.
Figure 1C:
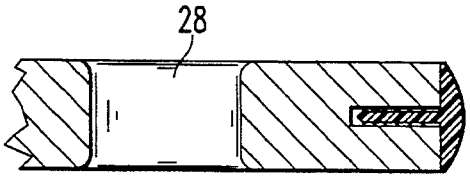
FIG. 1C is a sectional view taken along the lines 1C—1C in FIG. 1 showing elongated hand holes.

Referring now to FIGS. 1-1C, there is disclosed a preferred embodiment for an apparatus 10 useful in martial arts focus training for holding boards B in FIG. 1B to be struck and broken by a practitioner.

The apparatus includes a back board 11 typically 18 inches wide and 24 inches high of ¾ inch oak veneer plywood.

The corners of back board are angled at 12 to accommodate grasping through elongated holes 28 in a cross-over fashion (See FIG. 1C).

A pair of elongated wooden members 13, 14 are spaced vertically, secured to and extend vertically from the front surface 15 of backboard 11. Those members extending from backboard are secured by gluing and screwing into them through the backboard 11.

The inward, opposing faces 16, 17 of the members 13, 14 are generally parallel and define a board holding space there between. Members 13, 14 typically are ¾ inch oak lumber.

A pair of linear elongated spacer members 18, 19 extend from the backboard 11 along a portion of the inward faces 16, 17 of members 13, 14. Linear members 18, 19 serve to space boards from the backboard, with the first of a series of boards B resting against the outer surfaces 20, 21 of spacer members 18, 19. Spacer members 18, 19 typically are ⅜ inch oak lumber.

Pairs of support gussets 22, 23, typically ¾ inch oak lumber, are secured to the backboard 11 and the outer surfaces 24, 25 of members 13, 14.

Some means is provided to hold boards in the space between elongated members 13, 14 and against inward faces 20, 21. For example, holes are drilled at 26, 27 and a shock cord shown at C is pressed through the holes and its ends knotted. The cord C may then be wrapped around the boards B to secure same in the board space.

As noted above, the backboard 11 has slots at 28 near each corner for grasping purposes. The backboard may be held by two assistants crosswise. Slots instead of handles are preferred due to cost consideration. Also, handles would make it difficult to hold the backboard against a wall.

In use, the boards are placed between members 13, 14. Shock cords C secure same in place and assistants hold the backboard crosswise using the grasping slots 28. Then the practitioner focusing his force strikes the boards and breaks the boards. The apparatus 10 is much sturdier for use than manual holding of boards. It is much safer than manual holding. In manual holding when a board or boards are struck, the shock immediately goes to the holders' arms, whereas in my invention, the shock is absorbed by the apparatus.

Figure 2:
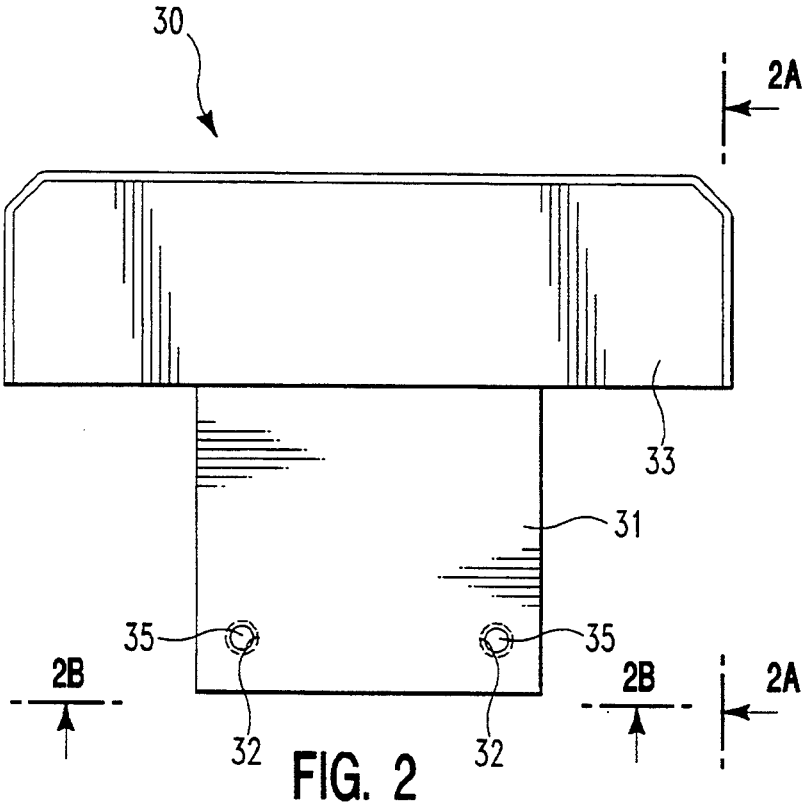
FIG. 2 is a front view of the board extender utilized with the apparatus of the present invention.
Figure 2A:
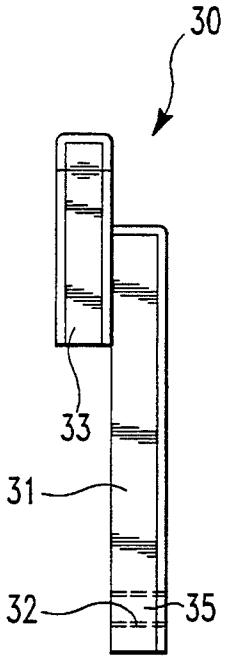
FIG. 2A is a side view of the board extender.
Figure 2B:
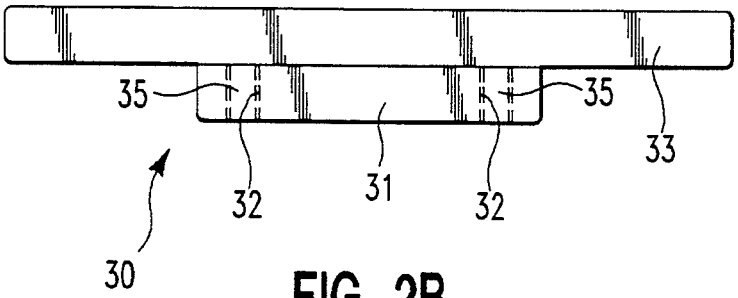
FIG. 2B is a top view of the board extender.

There will be times when one wants to mount additional boards on the apparatus in which case additional support means are required. Referring to FIGS. 2–2B and 1B, board extender 30 is seen as comprising an extension piece 31 having a pair of openings 32 and to which is secured board supporter 33. Openings are drilled in lower elongated member 14 and linear member 19 at 34. Threaded inserts 35 are secured within openings 32.

Figure 9:
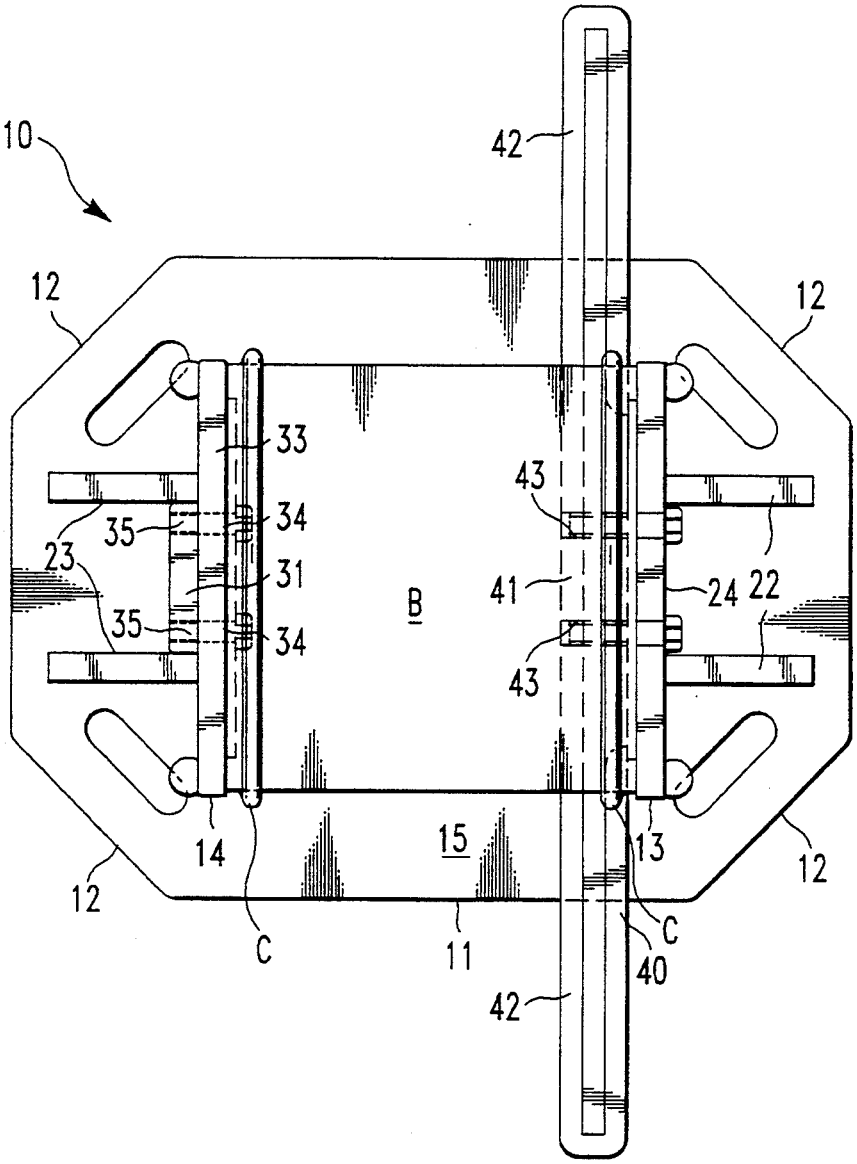
FIG. 9 is a front view of the apparatus of the present invention, with board extender and extension handle in place.
Figure 10:
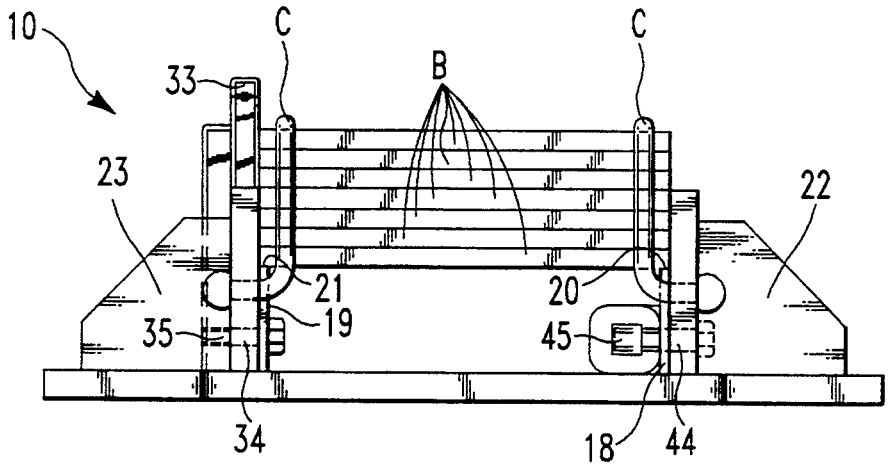
FIG. 10 is a top view of the apparatus with board extender and extension handle in place; and, FIG. 11 is a side view of the apparatus attached to the wall mount.

In use (See FIGS. 9 and 10) the board extender 30 is put in place and secured to the member 14 by passing the screw end of knobbed screws 36 through openings 34 and tightening same into the threaded inserts 35. The additional boards may then be placed on the board extender 30.

There are also times when one would want the apparatus to be held against a wall. For example, when the board extender 30 is being used and additional boards are held on the apparatus, one does not want two persons holding the apparatus while standing behind it. A much stronger backing can be provided if the apparatus can be held against a wall.

Figure 3:
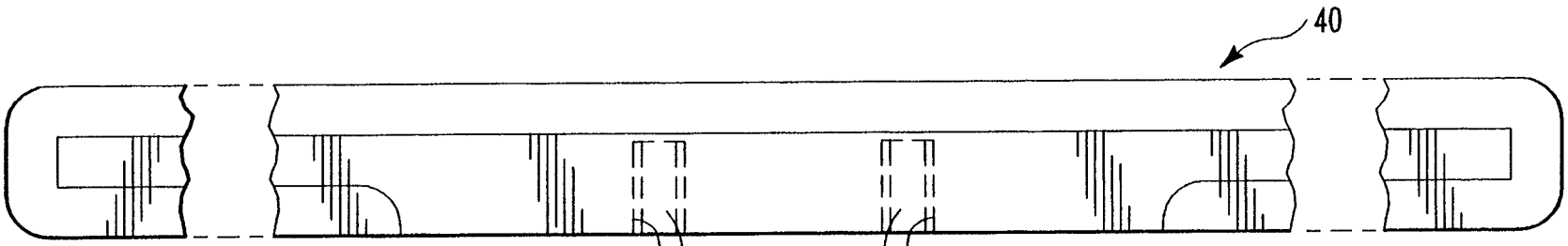
FIG. 3 is a broken away front view of an extension handle utilized with the present invention.
Figure 3A:
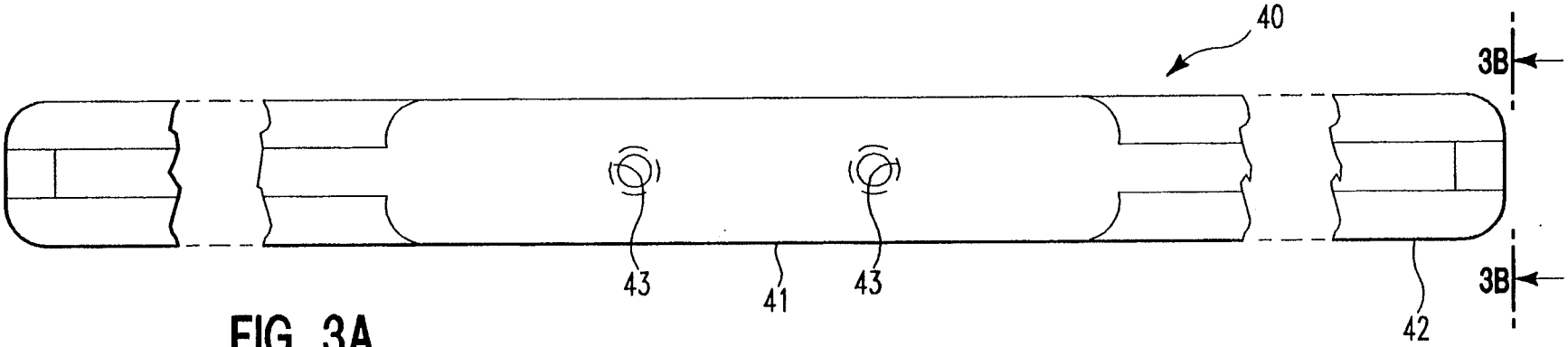
FIG. 3A is a top view of the extension handle.
Figure 3B:
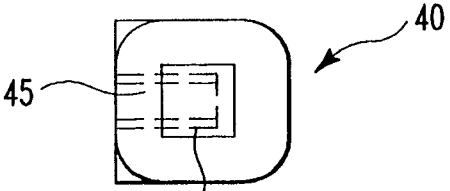
FIG. 3B is an end view of the extension handle taken along the line 3B—3B in FIG. 3A.

Towards this end and referring to FIGS. 3–3B and 1B, there is disclosed an extension handle 40 with a broad elongated central support section 41 and handle ends 42. The section 41 is provided with a pair of openings 43. Openings are drilled in upper elongated member 13 and linear member 18 at 44. Threaded inserts 45 are secured within openings 43.

In use (See FIGS. 9 and 10) the handle 40 is put in place and secured to member 13 by passing the screw end of knobbed screw 46 through openings 44 and tightening same into the threaded inserts 45. Assistants may then support the apparatus 10 by grasping the handle ends 42 and be able to hold the apparatus 10 against a wall.

Figure 4:
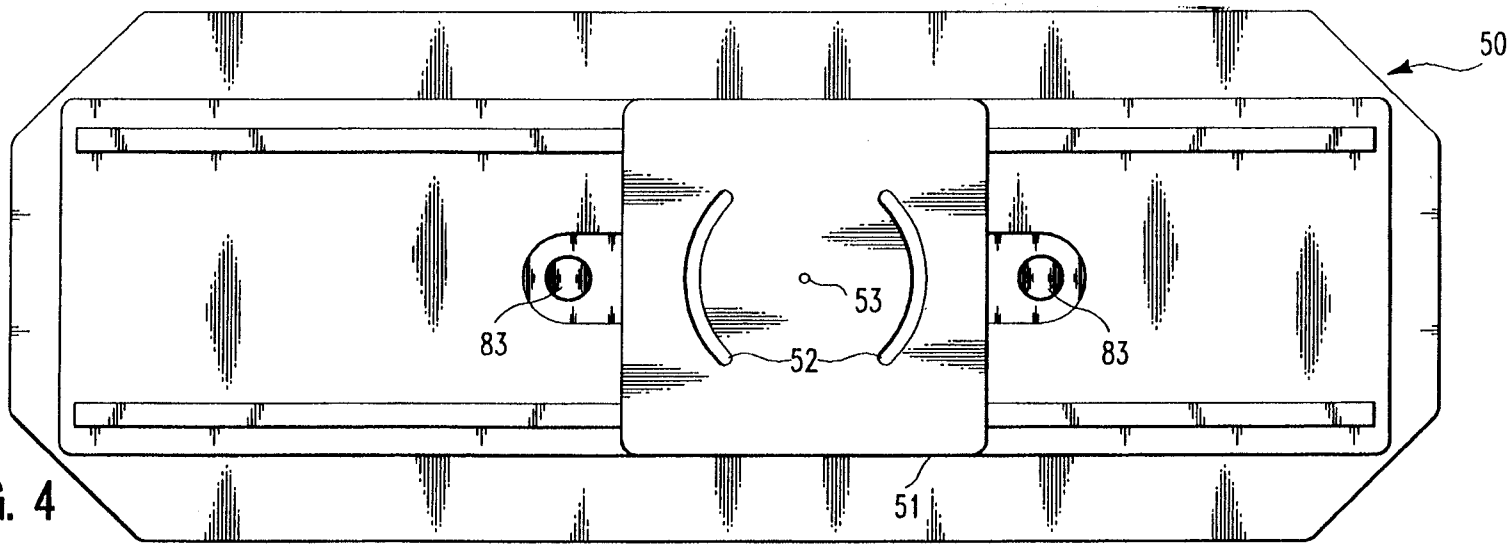
FIG. 4 is a front view of a preferred embodiment of the wall mount of the present invention.
Figure 5:
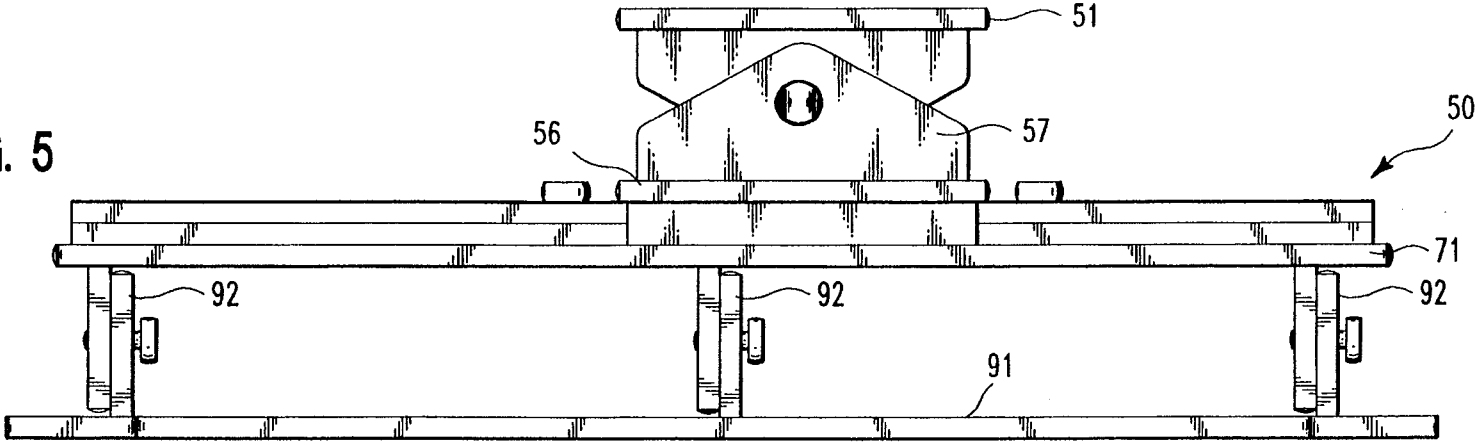
FIG. 5 is a side view of the wall mount.
Figure 6:
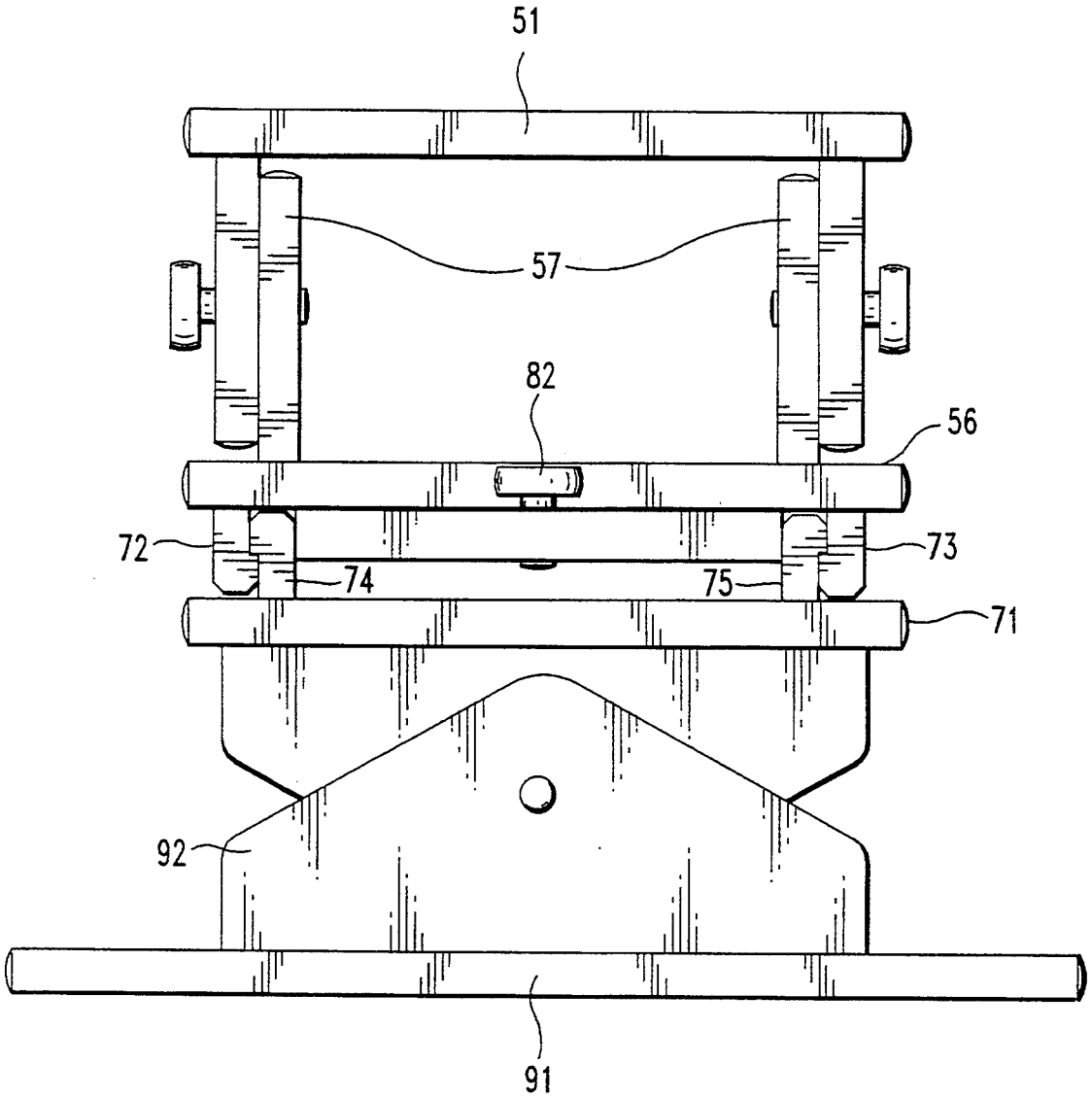
FIG. 6 is a top view of the wall mount.

Referring to FIGS. 4–6, my invention further includes a wall mount 50 for apparatus 10. In addition to allowing the apparatus 10 to be supported thereon, the wall mount 50 permits the board held on the apparatus to be presented in different planes and at different angles. The wood of a board breaks with the grain. So, the practitioner can orient the grain to a desired position depending how the force to a board is to be applied.

Referring to FIGS. 4–6 and 1, the wall mount 50 is seen as including a mounting plate 51 with curved slots 52 and central opening 53. The rear surface of backboard 11 is drilled and threaded inserts 54 secured within.

Figure 11:
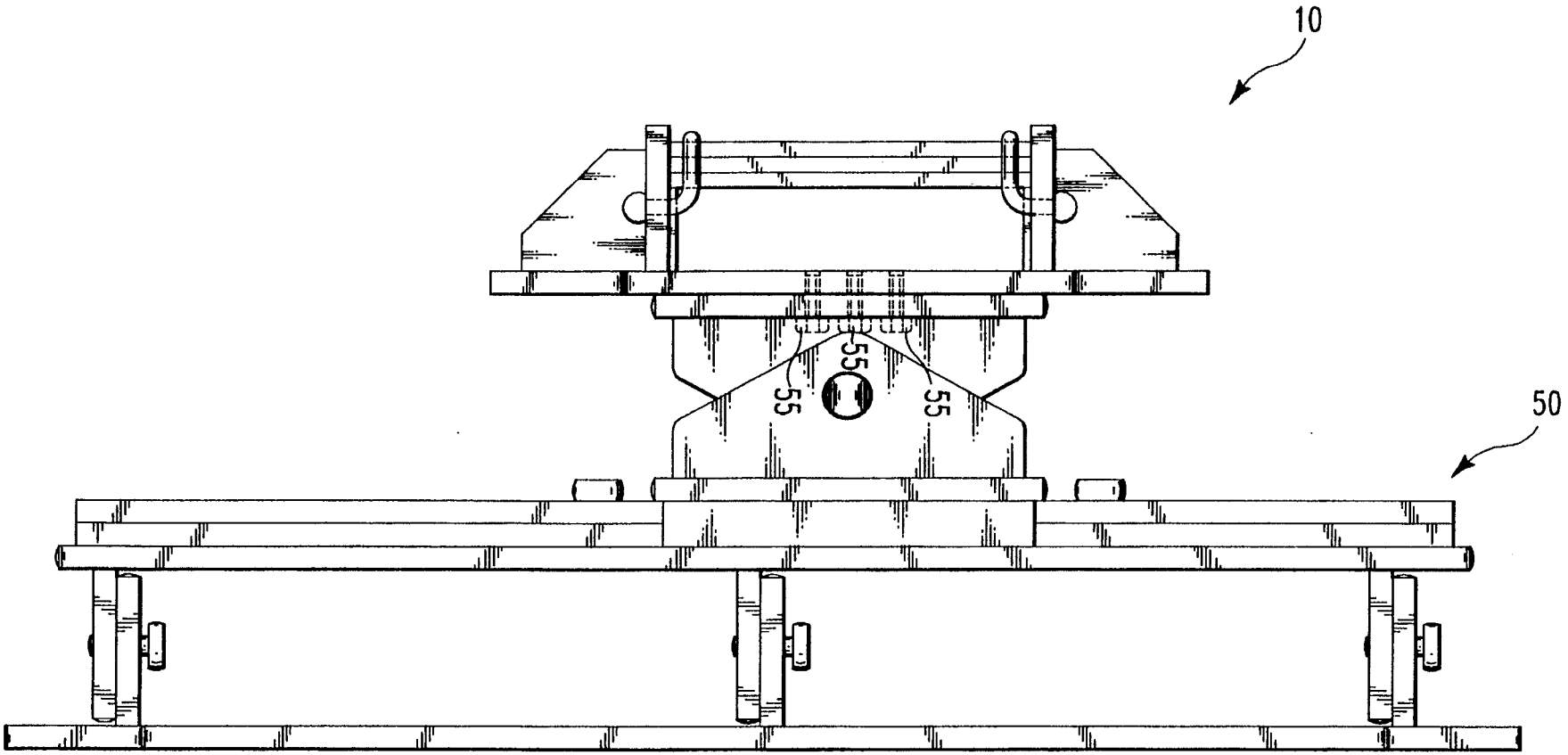

Apparatus 10 is secured to wall mount 50 (See FIG. 11) by passing the screw ends of knobbed screws 55 through slots 52 and opening 53 and tightening same into three threaded inserts 54. The knobbed screw through the central opening 53 and into the central threaded insert centers the apparatus 10 on the mounting plate 51, while passing a pair of the knobbed screws 55 through the curved slots 52 allows the apparatus 10 to be rotated in position relative to the practitioner.

Figure 7:
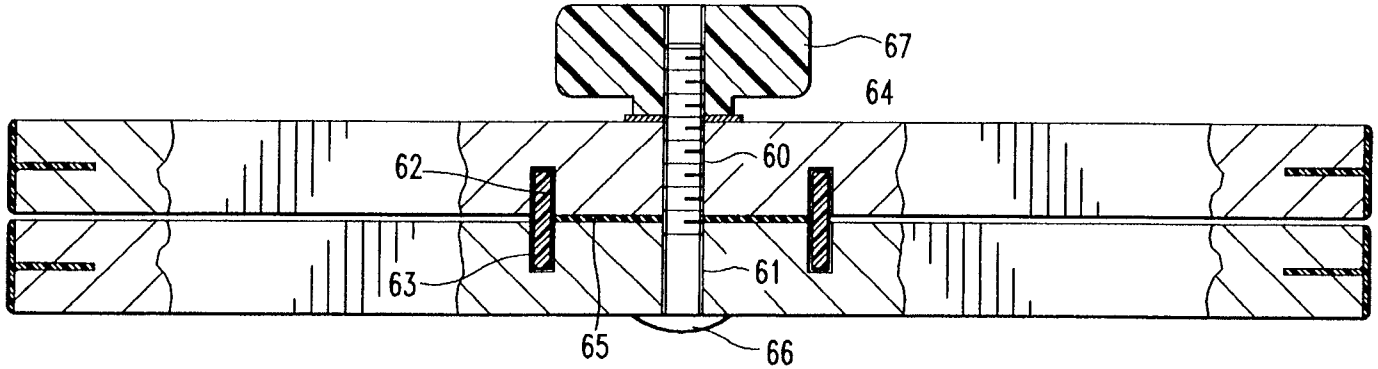
FIG. 7 is a cross sectional view of a pivotable member utilized n the present invention.
Figure 7A:
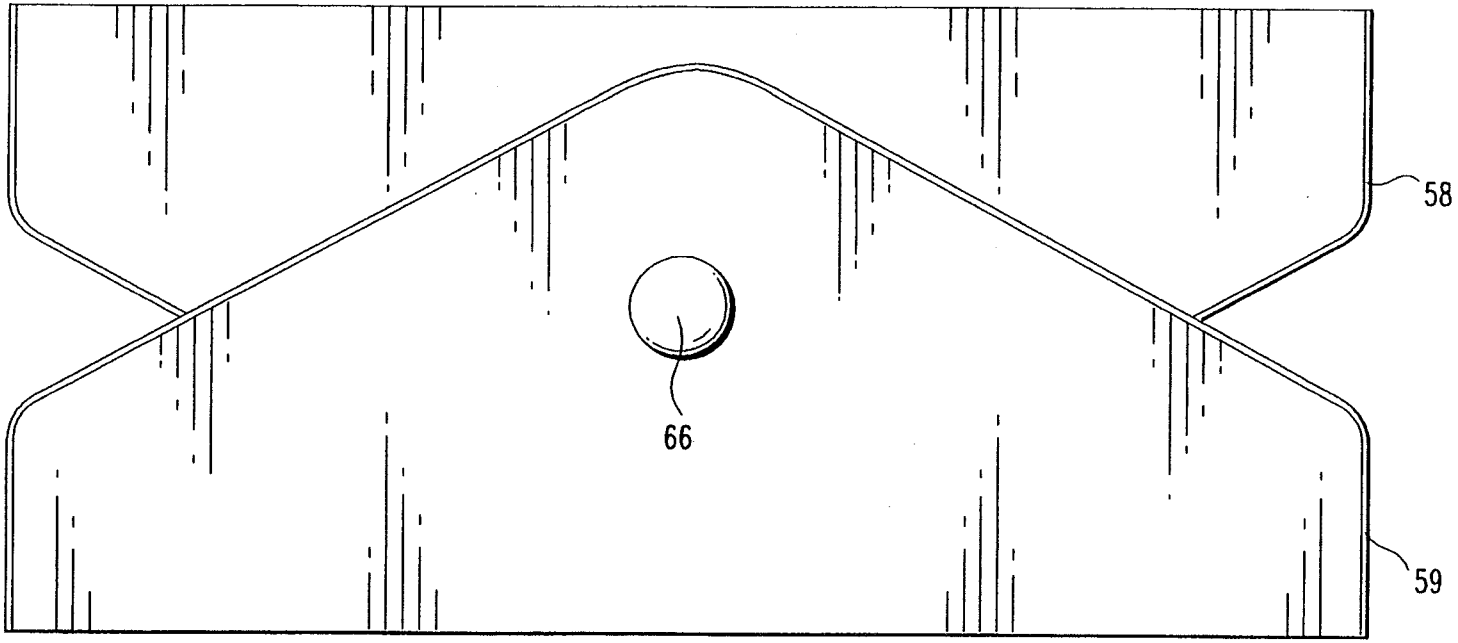
FIG. 7A is a side view of the pivotable member.

Mounting plate 51 is secured to a secondary slide board 56 via a pair of pivotable block means 57. Referring to FIGS. 7–7A, for the moment, each pivotal means 57 is seen as including pivotable members 58 and 59, centrally drilled at 60, 61 with opposing circular slots 62, 63 for receiving a plastic pipe segment 64, rubber friction washer 65, threaded carriage bolt 66, and fluted threaded plastic knob 67. The mounting plate 51 may be pivoted about a horizontal axis relative to the secondary slide board 56 and then secured in the desired position by tightening knobs 67. Pivot block means 57 allows rotation of the board 11 so it can be struck from above or below.

Figure 8A:
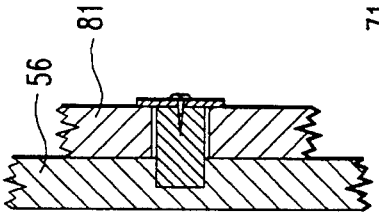
FIG. 8A is a sectional view taken along the lines 8A—8A of FIG. 8 showing how the cam is affixed to secondary slide board.
Figure 8B:
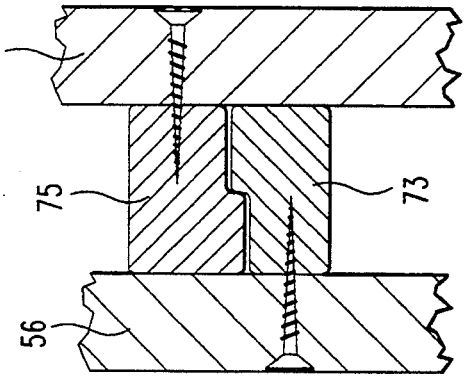
FIG. 8B is a sectional view taken along the lines 8B—8B of FIG. 8 showing vertical adjustment rails in detail.

Referring again to FIGS. 4–6, wall mount 50 is provided with a primary slide board 71. Secondary slide board is provided with outer rails 72, 73 while primary slide board is provided with inner rails 74, 75, permitting secondary board 56 to be raised or lowered relative to the primary slide board 71 (See FIG. 8B).

Figure 8:
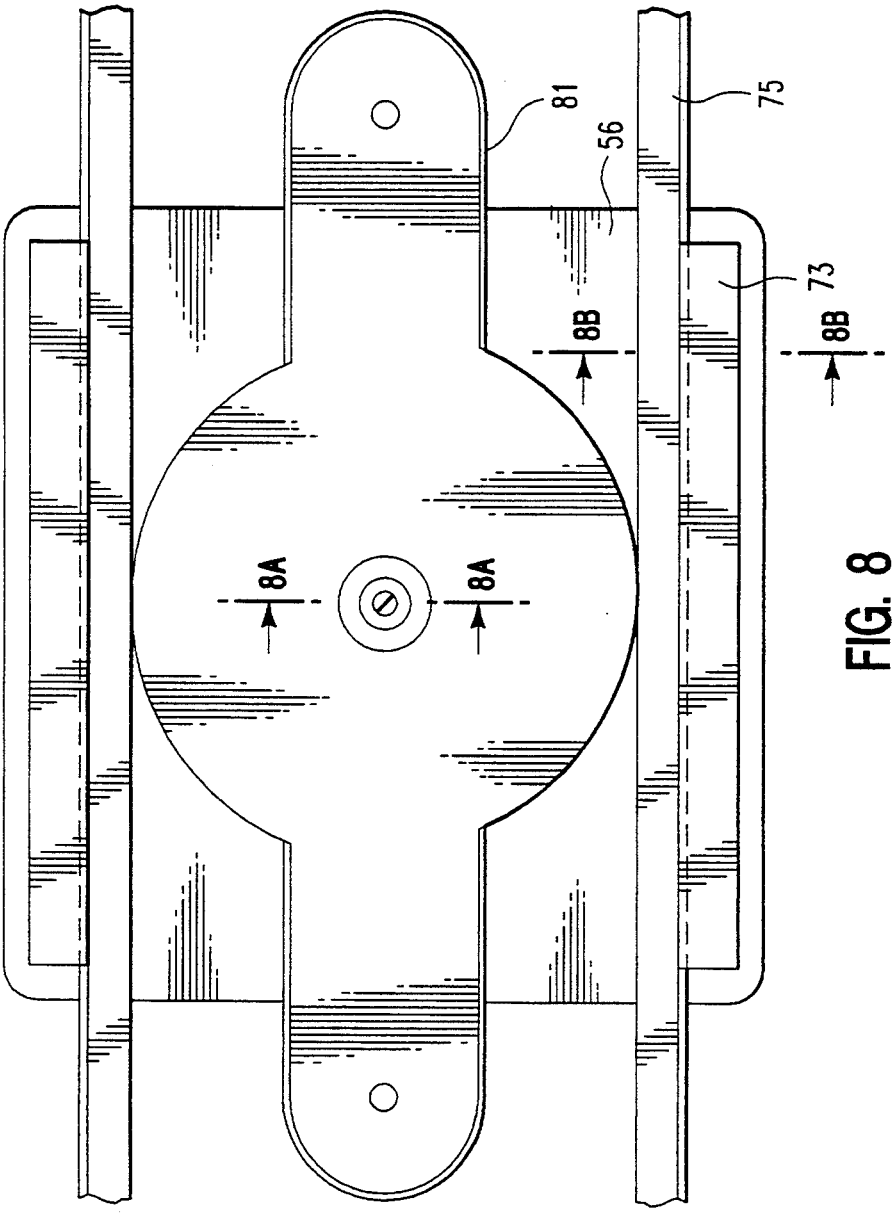
FIG. 8 is a back view of the offset cam lock utilized in the present invention.

When a desired height is reached secondary slide board 56 is held in place via offset cam lock 81 (best seen in FIG. 8) and fixed there by rotating cam lock 81. The cam lock rotates freely on a ¾" wooden dowel which is permanently glued into a corresponding ¾" diameter hole in the secondary slide board 56. Cam lock 81 is retained in place on dowel by an oversized washer which is screwed to dowel (See FIG. 8A). Knobs 83 at either end of cam lock 81 allow same to be grasped as, for example, when you break the cam lock 81 free. The slide board arrangement obviously permits raising and lowering of a board mounted on apparatus 10.

Primary slide board 71 is secured to a wall board 91 by means of pivotable block means 92 of the same type as previously described, and to allow pivotal action there between about a vertical axis and securement in a desired position. For example, one could execute a round house kick even though the board is held close to the wall.

The wall mount may be secured to a wall via six screws, spanned sixteen (16) inches apart (not shown).

It should be obvious that changes, additions and omissions may be made in the details and arrangement of parts without departing from the scope of the invention as defined in the appended claims.

What is claimed is:

1. Apparatus useful in martial arts focus training for holding boards to be struck and broken by a practitioner, comprising:

backboard;

board support means including, first and second elongated board holding members spaced vertically on, secured to and extending from said back board, each member having inward and opposing faces, said inward faces being generally parallel and defining a board holding space there between, linear elongated members extending from said back board along a portion of said inward faces of said board holding members, for spacing boards from said back board and having outer surfaces against which a board rests, and, a pair of support gussets secured to said back board and said opposing faces of a respective one of said board holding members;

means to permit holding boards on said board support means in the board holding space against said outer surfaces of said linear spacer members; and, means to allow said backboard to be grasped by holders assisting the practitioner.

2. The apparatus according to claim 1 wherein said backboard is slotted at its corners to form said backboard grasping means.

3. Apparatus according to claim 1 including extension means for securement to said apparatus to permit holding of additional boards on said apparatus.

4. Apparatus according to claim 1 including handle means for securement to said apparatus to permit holding of said apparatus.

5. A wall mount for the apparatus of claim 1 comprising:

a mounting plate means for securing the apparatus of claim 1 to said mounting plate;

means permitting angular positioning of said apparatus relative to said mounting plate;

a secondary slide board;

a first pivotal block means for securement of said mounting plate to said secondary board and permitting pivotal action there between;

a primary slide board;

means permitting longitudinal sliding action of said secondary slide board along said primary slide board;

means for locking said secondary slide board in position along said primary slide board;

a wall board; and, a second pivotable block means for securement of said secondary slide board to said wall board and permitting pivotal action there between.

* * * * *